US007783012B2

(12) United States Patent
Cao et al.

(10) Patent No.: US 7,783,012 B2
(45) Date of Patent: Aug. 24, 2010

(54) APPARATUS FOR A SURFACE GRADED X-RAY TUBE INSULATOR AND METHOD OF ASSEMBLING SAME

(75) Inventors: Yang Cao, Niskayuna, NY (US); Daniel Qi Tan, Rexford, NY (US); Richard Michael Roffers, Menomonee Falls, WI (US); Carey Shawn Rogers, Brookfield, WI (US)

(73) Assignee: General Electric Company, Niskayuna, NY (US)

( * ) Notice: Subject to any disclaimer, the term of this patent is extended or adjusted under 35 U.S.C. 154(b) by 32 days.

(21) Appl. No.: 12/210,822

(22) Filed: Sep. 15, 2008

(65) Prior Publication Data

US 2010/0067661 A1 Mar. 18, 2010

(51) Int. Cl.
*H01J 35/02* (2006.01)

(52) U.S. Cl. ..... 378/139; 378/118; 378/121

(58) Field of Classification Search ..... 378/117, 378/118, 121, 139
See application file for complete search history.

(56) References Cited

U.S. PATENT DOCUMENTS 3,473,028 A * 10/1969 Curry ..... 378/193
3,524,084 A * 8/1970 Horan ..... 310/319
4,499,592 A 2/1985 Brettschneider et al.
4,639,385 A 1/1987 Jolitz et al.
4,726,991 A * 2/1988 Hyatt et al. ..... 428/329
4,977,357 A * 12/1990 Shrier ..... 338/21
5,136,625 A * 8/1992 Heiting et al. ..... 378/139
5,159,618 A 10/1992 Blake
5,817,982 A * 10/1998 Arumugasaamy et al. ..... 174/120 R
6,064,094 A * 5/2000 Intrater et al. ..... 257/355
6,097,139 A 8/2000 Tuck et al.
6,477,033 B2 * 11/2002 Oshita et al. ..... 361/306.3
6,683,317 B1 1/2004 Simmons et al.
6,901,136 B1 5/2005 Tekletsadik et al.
7,020,244 B1 3/2006 Wilson et al.
7,218,707 B2 5/2007 Holm
7,236,568 B2 * 6/2007 Dinsmore et al. ..... 378/139
7,317,278 B2 * 1/2008 Busta ..... 313/495
7,430,278 B2 * 9/2008 Sundaram et al. ..... 378/139
7,521,851 B2 * 4/2009 Tolt ..... 313/311
2006/0084277 A1 4/2006 Nakashima et al.
2006/0099328 A1 * 5/2006 Waite et al. ..... 427/58
2008/0143465 A1 * 6/2008 Tan et al. ..... 336/5
2009/0038130 A1 * 2/2009 Cooke et al. ..... 29/25.35

FOREIGN PATENT DOCUMENTS

WO 2004079375 A2 9/2004

* cited by examiner

*Primary Examiner*—Edward J Glick
*Assistant Examiner*—Thomas R Artman
(74) *Attorney, Agent, or Firm*—Jason K. Klindtworth

(57) ABSTRACT

An insulator for a vacuum tube is disclosed and includes an electrically insulative bulk material and a first antiferroelectric coating applied to a first portion of the bulk material.

21 Claims, 8 Drawing Sheets

APPARATUS FOR A SURFACE GRADED X-RAY TUBE INSULATOR AND METHOD OF ASSEMBLING SAME

BACKGROUND OF THE INVENTION

The invention relates generally to x-ray tubes and, more particularly, to a method of fabricating a high-voltage insulator for x-ray tubes. The invention is described with respect to an x-ray system, but one skilled in the art will recognize that the invention may be used in, for instance, electron tubes or other devices in which high voltage instability occurs.

X-ray systems typically include an x-ray tube, a detector, and a gantry to support the x-ray tube and the detector. In operation, an imaging table, on which an object is positioned, is located between the x-ray tube and the detector. The x-ray tube typically emits radiation, such as x-rays, toward the object. The radiation typically passes through the object on the imaging table and impinges on the detector. As radiation passes through the object, internal structures of the object cause spatial variances in the radiation received at the detector. The detector then emits data received, and the system translates the radiation variances into an image, which may be used to evaluate the internal structure of the object. One skilled in the art will recognize that the object may include, but is not limited to, a patient in a medical imaging procedure and an inanimate object as in, for instance, a package in a computed tomography (CT) package scanner.

X-ray tubes may include a rotating anode structure for the purpose of distributing heat generated at a focal spot. The anode is typically rotated by an induction motor having a cylindrical rotor built into a cantilevered axle that supports a disc-shaped anode target and an iron stator structure with copper windings that surrounds an elongated neck of the x-ray tube. The rotor of the rotating anode assembly is driven by the stator. An x-ray tube cathode provides a focused electron beam that is accelerated across a cathode-to-anode vacuum gap and produces x-rays upon impact with the anode. Because of the high temperatures generated when the electron beam strikes the target, the anode assembly is typically rotated at high rotational speed.

Newer generation x-ray tubes have increasing demands for providing higher peak power and higher accelerating voltages. For instance, x-ray tubes used in medical applications typically operate at 140 kV or more, while 200 kV or more is common for x-ray tubes used in security applications. However, one skilled in the art will recognize that the invention is not limited to these voltages, and applications requiring greater than 200 kV may be equally applicable. At these voltages, x-ray tubes are susceptible to high-voltage instability and insulator surface flashover which can reduce the life expectancy of the x-ray tube or interfere with the operation of the imaging system.

In a typical x-ray tube, there is a disk-shaped ceramic insulator having an opening for electrical feeds therein. The cathode post, or conduit for the electrical feeds, typically houses three or more electrical leads for feeding voltage to the cathode. Typically, the insulator, at its center opening, is attached to the cathode post which may structurally support the cathode. The cathode typically includes one or more tungsten filaments. At its perimeter, the insulator is typically hermetically connected to a cylindrical frame, which houses a vacuum chamber in which the anode and the cathode are typically positioned.

X-ray tubes may operate at up to 100 kW peak power, and at an average power of 5 kW for hours at a time. X-ray tubes are susceptible to high-voltage stresses at the junctions between the insulator and center cathode support structure, and between the insulator and x-ray tube frame. These junctions are commonly referred to as triple-point junctions describing the intersection of metal, dielectric, and vacuum. Triple-point junctions are common sources of high-voltage instability due to field emission of electrons that can reduce the life expectancy of the x-ray tube.

Imperfections on the insulator surface in the vacuum region can include particles of surface contamination, pores or voids, and grooves and pits from machining and may lead to secondary electron emission. This occurs when field emitted electrons strike the insulator surface, releasing more electrons into the vacuum region. A cascading effect can lead to electrical arcing and insulator surface flashover. The potential for insulator surface flashover in an x-ray tube may be reduced by decreasing the intensity of the electric field at the insulator surface near the triple-point junction and by eliminating the imperfections along the insulator surface that contribute to secondary electron emission.

Blasting an insulator surface with steel or glass beads can clean the surface and reduce surface roughness to roughly 1-3 microns. This method may reduce secondary electron emission and the likelihood of insulator surface flashover, enough for most low-voltage x-ray tube applications. For high-voltage applications, mechanical polishing or electropolishing offers better results than surface blasting by reducing surface roughness to 0.05 to 0.2 microns. But even using these improved production methods, the insulators are still susceptible to electrical breakdown at higher operating voltages.

Computed tomography (CT) systems represent an advanced application of x-ray tube technology. To improve the functionality of CT imaging, greater demands are placed on x-ray tubes. The need to increase patient throughput puts a premium on reducing scan times. The combination of shorter scan times and higher patient loads often translates into higher operating voltages and more frequent use for CT system x-ray tubes further increasing the potential for electrical breakdown.

Therefore, it would be desirable to have a method of fabricating a high-voltage insulator for an x-ray tube or vacuum tube that is resistant to insulator surface flashover caused by field emission and secondary electron emission.

BRIEF DESCRIPTION OF THE INVENTION

The invention provides an apparatus and method for fabricating an insulator having improved voltage stability.

According to one aspect of the invention, an insulator for a vacuum tube includes an electrically insulative bulk material and a first antiferroelectric coating applied to a first portion of the bulk material.

In accordance with another aspect of the invention, a method of manufacturing an insulator for a vacuum tube includes providing an electrically insulative bulk material and applying a first antiferroelectric coating to a first surface of the bulk material.

Yet another aspect of the invention includes an x-ray tube assembly including a cathode, an anode, and an insulator comprising a ceramic bulk material having a first surface and a contiguous second surface. The assembly also includes a first nanoceramic coating, having a field dependent first dielectric constant, applied to the first surface.

Various other features and advantages of the invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION OF THE PREFERRED EMBODIMENT

Figure 1:
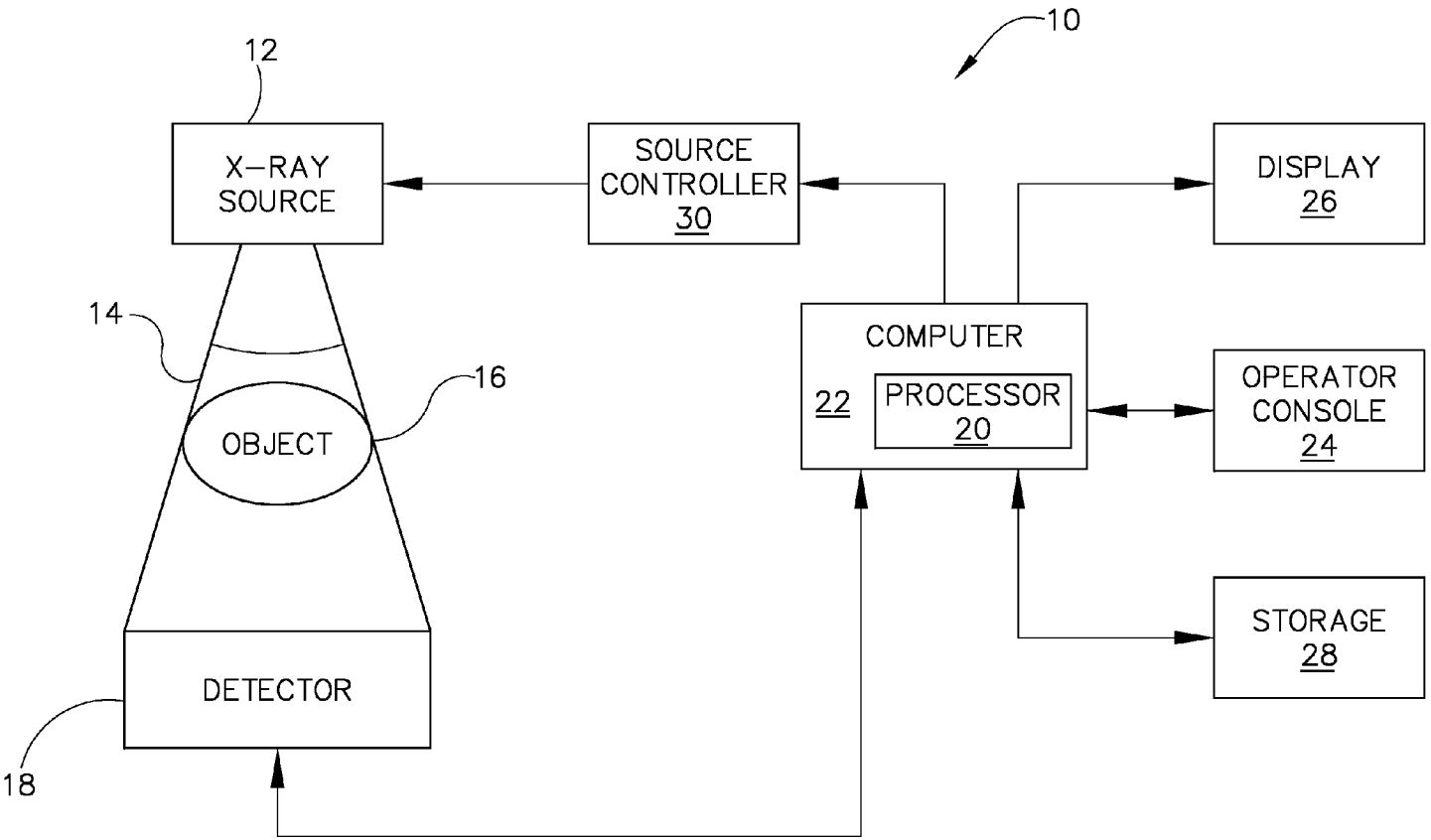
FIG. 1 is a block diagram of an imaging system that can benefit from incorporation of an embodiment of the invention.

FIG. 1 is a block diagram of an embodiment of an imaging system 10 designed both to acquire original image data and to process the image data for display and/or analysis in accordance with the invention. It will be appreciated by those skilled in the art that the invention is applicable to numerous medical or industrial imaging systems utilizing an x-ray tube, such as projection x-ray or mammography systems. Other imaging systems such as computed tomography systems and digital radiography systems, which acquire image three dimensional data for a volume, also benefit from the invention. The following discussion of projection x-ray system 10 is merely an example of one such implementation and is not intended to be limiting in terms of modality.

As shown in FIG. 1, x-ray system 10 includes an x-ray tube or source 12 configured to project a beam of x-rays 14 through an object 16. Object 16 may include a human subject, pieces of baggage, or other objects desired to be scanned. X-ray source 12 may be a conventional x-ray tube producing x-rays having a spectrum of energies that range, typically, from 30 kV to 200 kV. The x-rays 14 pass through object 16 and, after being attenuated by object 16, impinge upon a detector 18. Each cell in detector 18 produces an analog electrical signal that represents the intensity of an impinging x-ray beam, and hence the attenuated beam, after it passes through object 16. In one embodiment, detector 18 is a scintillation-based detector, however, it is envisioned that direct-conversion type detectors (e.g., CZT detectors, etc.) may also be implemented.

A processor 20 receives the analog electrical signals from detector 18 and generates an image corresponding to the object 16 being scanned. A computer 22 communicates with processor 20 to enable an operator, using operator console 24, to control the scanning parameters and to view the generated image. That is, operator console 24 includes some form of operator interface, such as a keyboard, mouse, voice activated controller, or any other suitable input apparatus that allows an operator to control x-ray system 10 and view the reconstructed image or other data from computer 22 on a display unit 26. Additionally, console 24 allows an operator to store the generated image in a storage device 28 which may include hard drives, floppy discs, compact discs, etc. The operator may also use console 24 to provide commands and instructions to computer 22 for controlling a source controller 30 that provides power and timing signals to x-ray source 12.

Moreover, embodiments of the invention will be described with respect to use in an x-ray tube. However, one skilled in the art will further appreciate that the invention is equally applicable for other systems (e.g., electron tubes) that require the installation of an electrical insulator that operates under high voltage, having a propensity to experience surface flashover or voltage instability.

Figure 2:
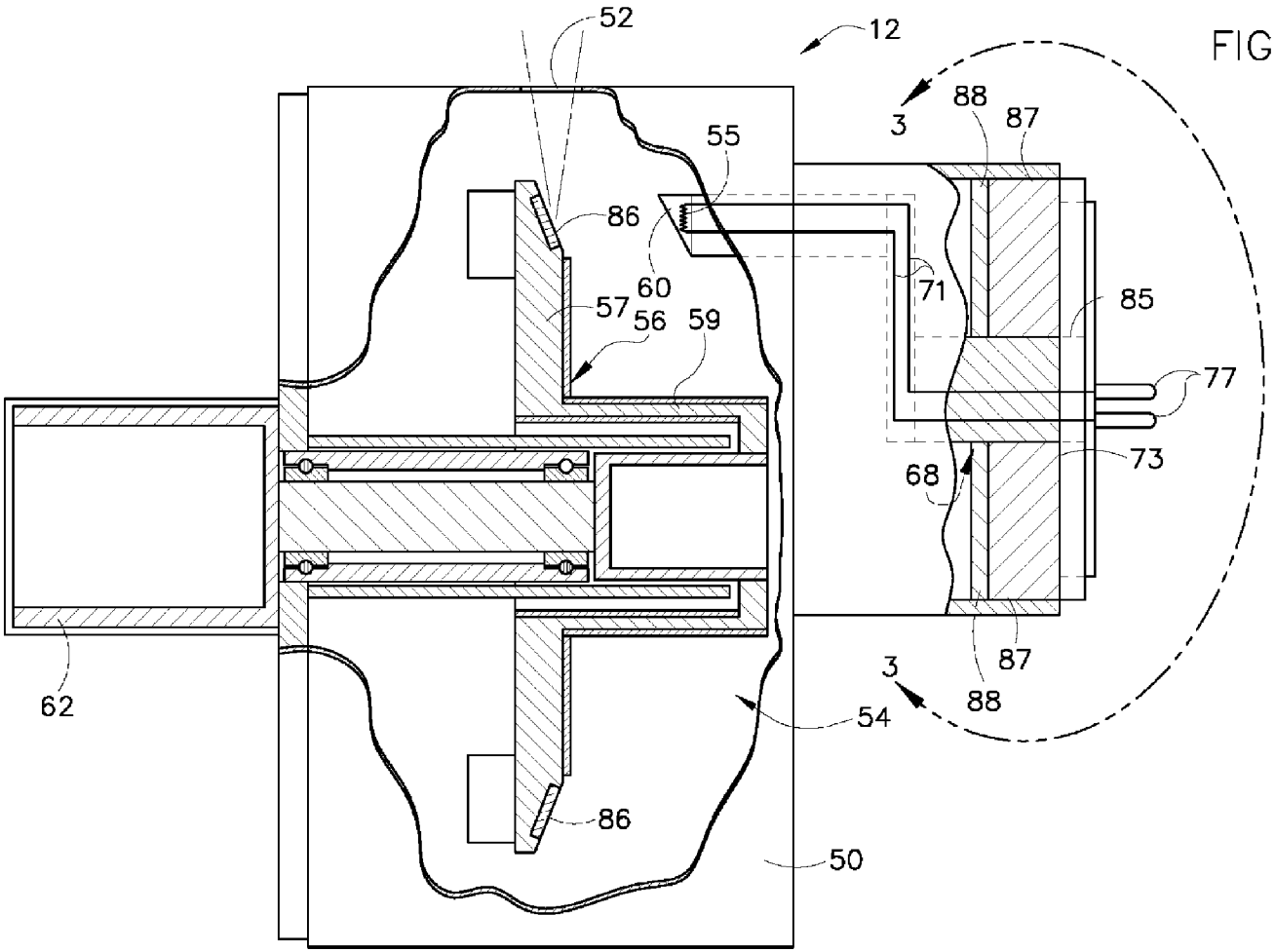
FIG. 2 a cross-sectional view of an x-ray tube having an insulator with a coating according to an embodiment of the invention and is useable with the system illustrated in FIG. 1.

FIG. 2 illustrates a cross-sectional view of an x-ray tube 12 incorporating an embodiment of the invention. X-ray tube 12 includes a frame 50 having a radiation emission passage 52 formed therein. Frame 50 surrounds an enclosure, or vacuum region 54, and houses an anode 56, a bearing cartridge 58, a cathode 60, and a rotor 62. Anode 56 includes a target 57 having a target material 86, and having a target shaft 59 attached thereto.

Cathode 60 typically includes one or more filaments 55. Cathode filaments 55 are powered by electrical leads 71 that pass through a center post 68 in vacuum region 54. In operation, an electric current is applied to the desired filament 55 via electrical contacts 77 to heat filament 55 so that electrons may be emitted therefrom. A high-voltage electric potential is applied between anode 56 and cathode 60, and the difference therebetween results in an electron beam flowing through vacuum region 54 from cathode 60 to anode 56. As a result, an electric field is generated within vacuum region 54.

Center post 68 is typically positioned at the center of, and attached to, an insulator 73 having an inner perimeter 85 and an outer perimeter 87. Electrical leads 71 connect to electrical contacts 77 on the exterior of x-ray tube 12. Insulator 73 is typically fabricated of alumina or other ceramic materials such as steatite or aluminum nitride. A coating 88 is applied to insulator 73 to increase voltage stability.

Figure 3:
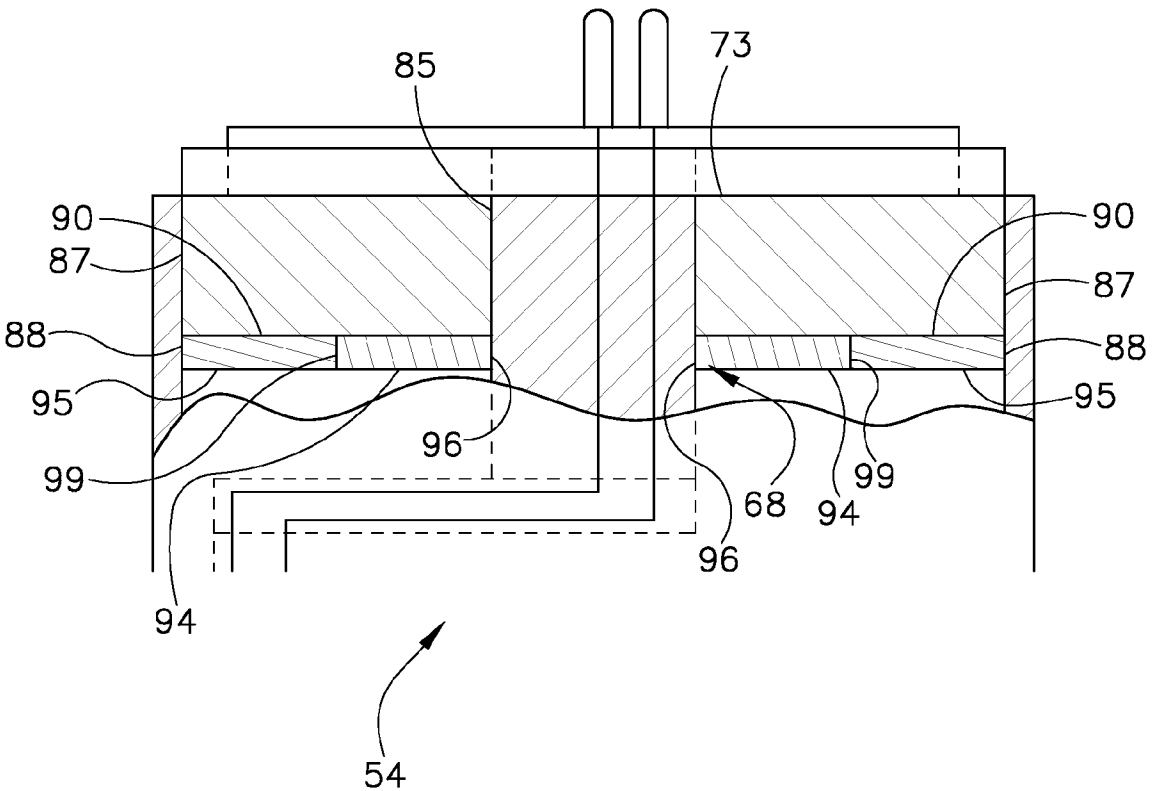
FIG. 3 is a cross-sectional view of a portion of FIG. 2 taken along Line 3-3.

FIG. 3 is a cross-sectional view of a portion of FIG. 2 illustrating an embodiment of the invention as applied to, for instance, the x-ray tube 12 of FIG. 2. In this embodiment, a triple-point junction 96 occurs at an intersection between inner perimeter 85 of insulator 73, center post 68 and vacuum region 54. According to an embodiment of the invention, coating 88 includes a first antiferroelectric (AFE) coating 94 applied at junction 96 around the entire circumference thereof and extending along a surface 90 of insulator 73 to a boundary 99. Coating 88 also includes a second AFE coating 95 applied to surface 90 at a distance from triple-point junction 96 starting at boundary 99 and extending to an outer perimeter 87. In an alternate embodiment, the two coatings 94, 95 may cover less than the entire portion of insulator surface 90 exposed to vacuum region 54. One skilled in the art will recognize that the thickness of coating 88 relative to the thickness of insulator 73 as depicted in FIGS. 2 and 3 is exaggerated to show the structure of the coating 88 as applied to insulator 73. As envisioned, and as will become clear from the details to follow, the AFE coating thickness relative to the insulator thickness is smaller than depicted in FIGS. 2 and 3.

Figure 4:
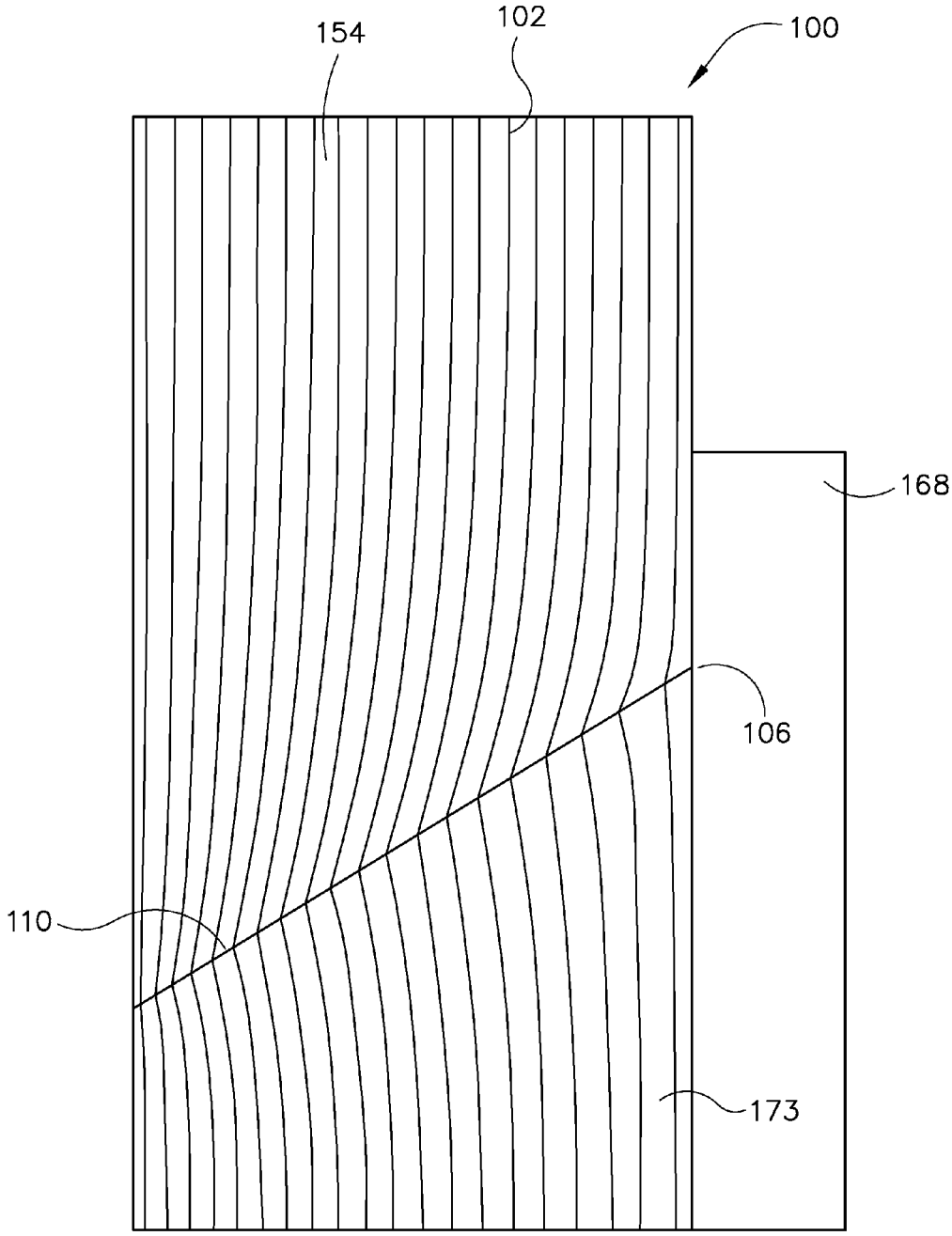
FIG. 4 PRIOR ART
FIG. 4 is a cross-sectional view showing electric field force lines passing through a portion of a vacuum tube insulator with no antiferroelectric coating.

FIG. 4 is a cross-sectional view of a prior art vacuum tube showing electric field force lines passing through a portion of a vacuum tube insulator with no AFE coating. FIG. 4 shows a center post 168 and an insulator 173 usable in a vacuum tube or an x-ray tube (not shown). An electric field 100, generated in a vacuum region 154, is represented by a plurality of electric field force lines 102. The embodiment further includes an insulator surface 110 and a center post 168 that define a boundary portion of vacuum region 154. A typical insulator 173 is shaped in a geometry, such as that shown in FIG. 4, to mitigate the electric field 100 at a junction of metal-dielectric-vacuum, commonly referred to as a triple-point junction 106, which, in this case, occurs at the junction between insulator 173, center post 168, and vacuum region 154. However, as indicated by the evenly spaced field lines 102, the mitigation effect is limited. The presence of defects on insulator surface 180 near cathode triple junction 106 along with the presence of micro-protrusions on center post 168 near cathode triple junction 106, enhances the field at triple-point junction 106 and may lead to field emission of electrons from junction 106, which gain kinetic energy from electric field 100 at insulator surface 110 such that the electrons are caused to cascade along insulator surface 110. Electrons with high kinetic energy may strike insulator surface 110 and produce more electrons through secondary electron emission avalanche. The combination of field emission and secondary electron emission can lead to insulator surface flashover, a condition characterized by electrical arcing along insulator surface 110.

There are at least two primary factors that determine the potential for secondary electron emission along an insulator surface. The insulator material is one factor, while another factor relates to the number and severity of surface defects on the insulator. As explained above, surface contamination, exposed pores or voids, damage from machining, and weak grain boundaries can increase secondary electron emission yield in x-ray tube insulators.

The likelihood of surface flashover may be reduced, according to embodiments of the invention, by reducing the electron emission at triple-point junctions and by reducing the potential for secondary electron emission from surfaces therein, by use of an AFE material. An AFE material, typically ceramic, has a voltage-dependent dielectric constant that can result in either an increase or a decrease of the dielectric constant, depending on the formulation. Formulations of AFE materials are described below, according to embodiments of the invention. Choosing an AFE material whose dielectric constant increases with increasing voltage will force the electric field into the bulk insulator material at high voltage. Increasing the size of the electric field in this manner reduces the localized field intensity at the surface, leading to a reduction in secondary electron emission. In contrast, an AFE material whose dielectric constant decreases with increasing voltage will force the electric field out of the bulk insulator material at high voltage.

Embodiments of the invention include a nonlinear ceramic coating having AFE particles with an average size of five to ten nanometers. Another embodiment of the invention includes a coating in which the average AFE particles size is from 50 to 500 nanometers. According to another embodiment, the coating includes AFE particles with size ranging from 100 to 400 nanometers. Yet another embodiment includes a coating having AFE particle sizes from 10 to 1000 nanometers.

Figure 5:
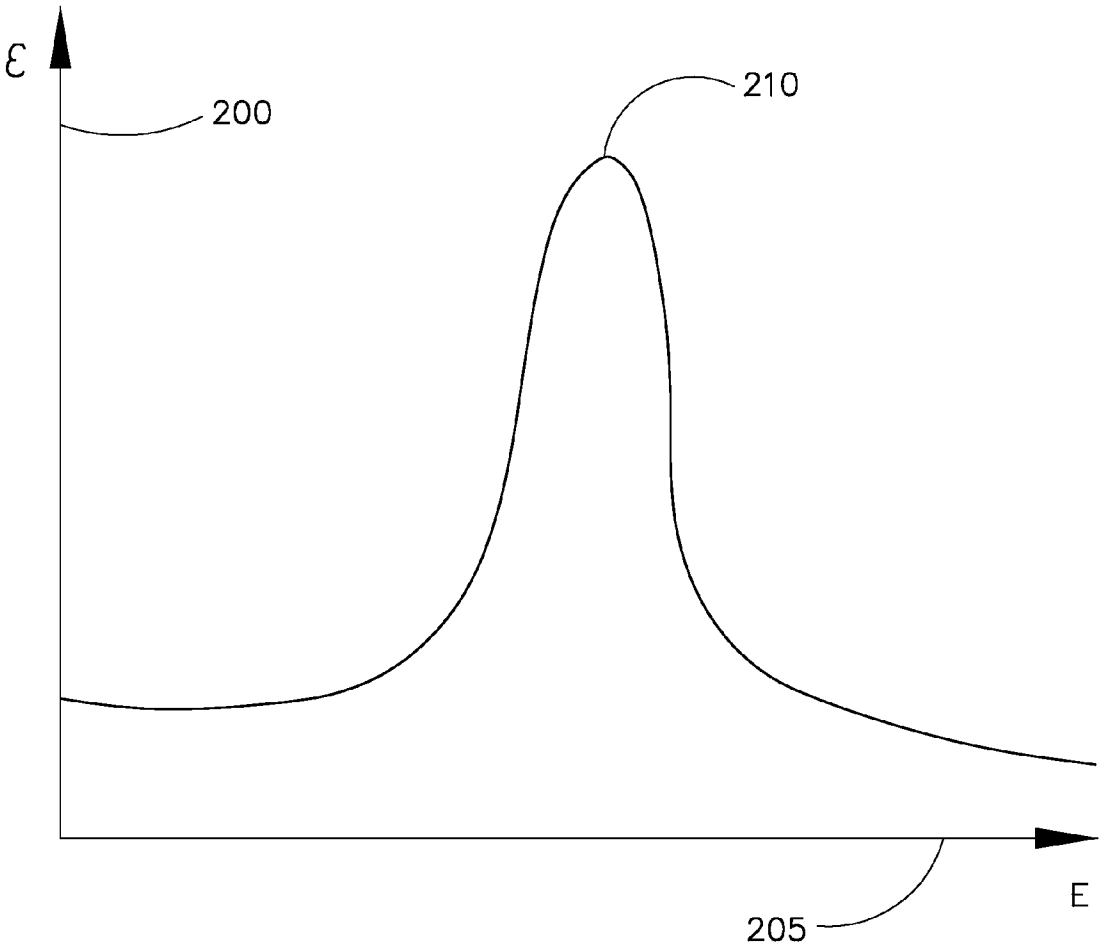
FIG. 5 is a graph illustrating a nonlinear relationship between dielectric constant and electric field for a typical antiferroelectric material.

Referring to FIG. 5, a graph illustrating a nonlinear relationship between dielectric constant and electric field for a typical antiferroelectric (AFE) material is shown. A nonlinear relationship between dielectric constant, shown on a y-axis 200, and electric field, shown on an x-axis 205, is shown for a typical AFE material. The sharp peak 210 in the dielectric constant indicates the strength of the electric field necessary to force a transition from a low dielectric state to a high dielectric state. In embodiments of the invention, AFE materials are selectively designed such that the AFE particles undergo a transition from an antiferroelectric state (low dielectric constant) to a ferroelectric state (high dielectric constant) when subjected to an electrical biasing field of approximately 1, 5, 10, and 100 kilovolts per millimeter, depending on the application. Likewise, in embodiments of the invention, the post-transition dielectric constant of the AFE coating may be selectively designed to be approximately 50%, 100%, and 500% greater than the pre-transition dielectric constant. In alternate embodiments, once beyond the phase transition from antiferroelectric to ferroelectric state, polarization saturation may cause the dielectric constant of the AFE coating to decrease. Thus, in embodiments of the invention, the decrease in dielectric constant upon phase transition of the AFE coating due to polarization saturation is approximately 50%, 100%, and 500%.

AFE materials suitable for use in coating x-ray tube insulators include, but are not limited to, lead zirconate ($PbZrO_3$), lead zirconate titanate ($Pb(Zr_yTi_{1-y})O_3$), lead hafnate ($PbHfO_3$), sodium niobate (NaNbO3), and lanthanum-modified lead zirconate ($Pb_{1-x}La_xZrO_3$) where x may range from zero to about one. Another suitable AFE material includes lanthanum-modified lead zirconium titanate ($Pb_{1-x}La_x(Zr_yTi_{1-y})O_3$) (PLZT), where x and y may range from zero to about one and are independent of each other. Another suitable AFE material includes lanthanum-modified lead zirconium titanate stannate $Pb_{1-x}La_x(Zr_yTi_{1-y-z}Sn_z)_{1-x/4}O_3$ (PLZST), where x, y, and z may range from zero up to about one and are independent of each other. Furthermore, the lanthanum in the above materials can be replaced by niobium to yield more AFE materials suitable for use as an insulator coating.

AFE coatings can be applied by various techniques including chemical vapor deposition, physical vapor deposition, sol-gel dip coating, thermal plasma spraying, brush painting. To shorten the cycle time for coating application, the coatings can be dried in an oven generally at temperatures less than 600° C.

Figure 6:
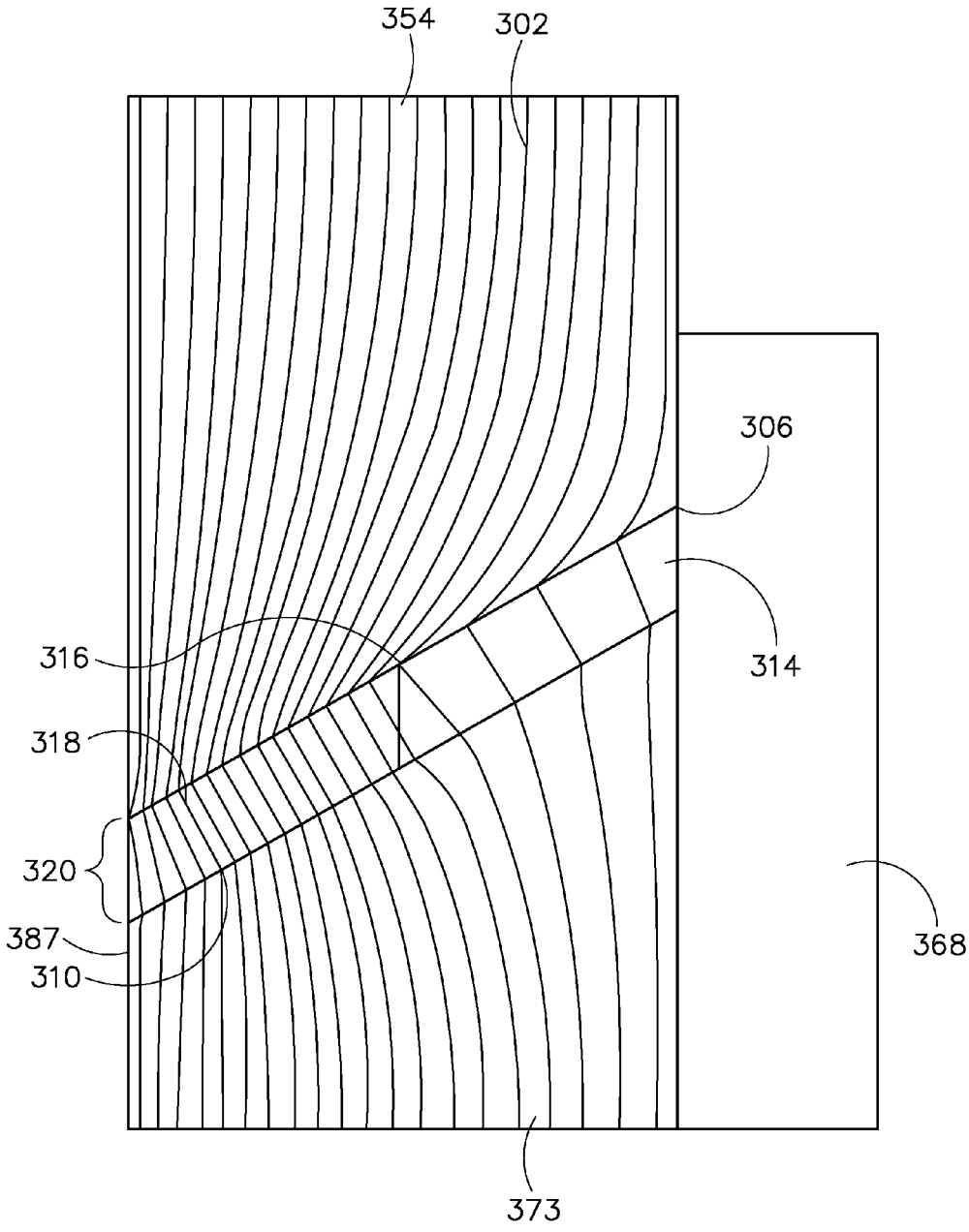
FIG. 6 is a cross-sectional view showing electric field force lines passing through a portion of a vacuum tube insulator with an antiferroelectric coating according to an embodiment of the invention.

FIG. 6 is a cross-sectional view showing electric field force lines passing through a vacuum region 354 and a portion of a vacuum tube insulator 373 with an AFE coating according to an embodiment of the invention. FIG. 6 shows a triple-point junction 306 at the intersection of insulator 373, vacuum region 354, and a center post 368. Insulator 373 has a first AFE coating 314, which has a dielectric constant that increases with increasing voltage. First AFE coating 314 is used in combination with a second AFE coating 318 whose dielectric constant decreases with increasing voltage. There is a boundary 316 between the first and second coatings 314, 318. The effect of first coating 314, applied to an insulator surface 310 at triple-point junction 306 and extending to boundary 316, is to reduce the electric field flux density at triple-point junction 306 as indicated by the widening distance between a set of equipotential lines 302. The effect of second coating 318, applied at boundary 116 and extending to an outer perimeter 387, is to increase the flux density at a distance from triple-point junction 306 as illustrated by the decreasing distance between equipotential lines 302 farther away from triple-point junction 306.

A lower electric field flux density at triple-point junction 306 may reduce electron field emission therefrom and may reduce the likelihood of surface flashover. AFE coatings 314, 318 can also reduce the incidence of secondary electron emission by filling and covering imperfections in insulator surface 310. The effects of surface damage from machining, surface contamination, and exposed voids in the material may be eliminated by application of an AFE coating that provides a smooth layer on the insulator surface to reduce surface roughness.

A ceramic AFE coating having nanoceramic particle may offer greater reduction of secondary electron emission yield than a coating using larger AFE particles. Nanoceramic particles, typically less than 100 nanometers in size, can more easily fill small exposed voids or microscopic surface defects while producing a smooth surface. Additionally, the use of nanoceramic particles permits a reduction in coating thicknesses commensurate with the reduction in the size of the particles leading to more efficient use of coating materials. Referring again to FIG. 6, in an embodiment of the invention, an AFE coating thickness 320 is approximately 100 nanometers. However, in embodiments of the invention the coatings 314, 318 may have thicknesses 320 ranging from approximately 100 nanometers to 50 microns.

Figure 7:
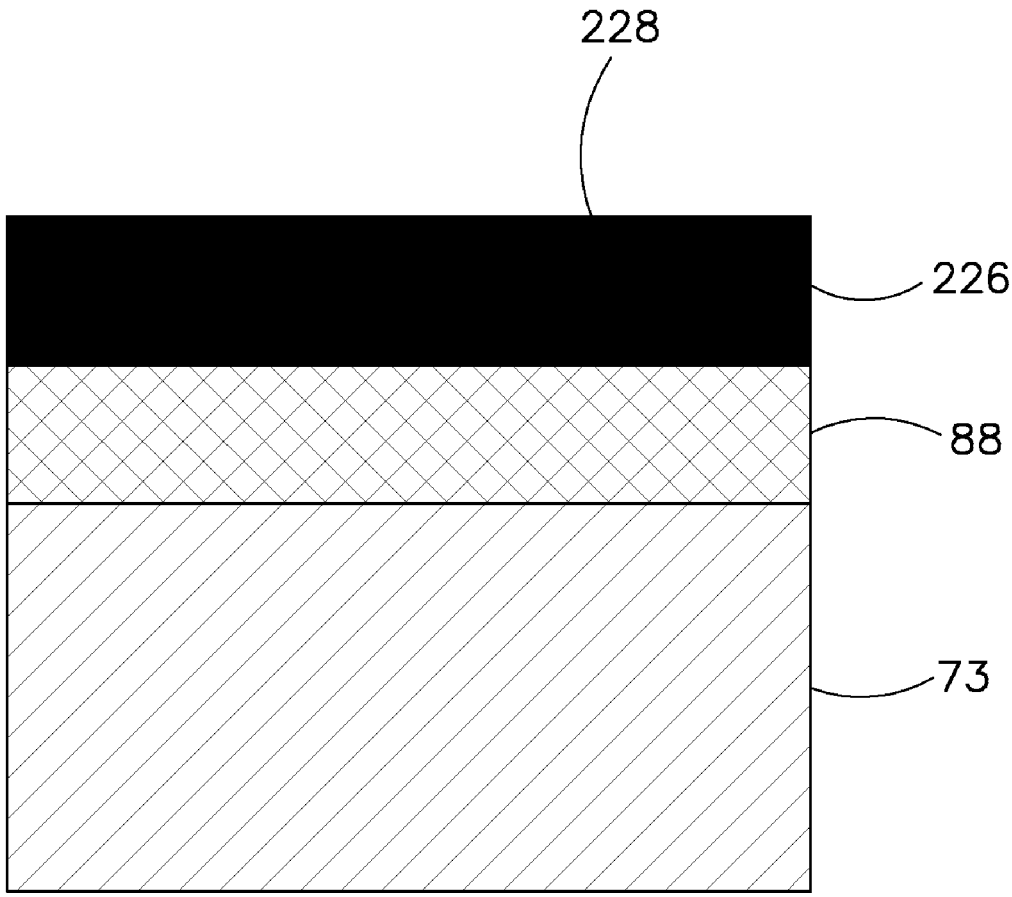
FIG. 7 is a cross-sectional view of an insulator with an antiferroelectric coating and a semiconductor coating according to an embodiment of the invention.

Referring to FIG. 7, a cross-section of insulator 73 and coating 88 of FIGS. 2 and 3 with an additional semiconductor coating 226 according to an embodiment of the invention is shown. Electrons in a semiconductor coating 226 have a higher mobility than those in an AFE coating 88, thus reducing the likelihood that there will be an accumulation of localized charges on a surface 228 of semiconductor coating 226 during x-ray tube operation. The surface charges evened out in this manner reduce the electrical field stress at semiconductor coating surface 228, thereby reducing secondary electron emission yield. Thus, further reductions in the potential for secondary electron emission may be realized by the application of semiconductor coating 226 over AFE coating 88. In an embodiment of the invention, semiconductor coating 226 includes one of chromium oxide (Cr2O3), zinc oxide (ZnO), and silicon carbide (SiC) that is used to coat an insulator 73 already having a first AFE coating 88. In alternate embodiments, semiconductor coating 226 may include one of Si (silicon), $Al_2O_3$—$Cr_2O_3$ (mixture of aluminum oxide and chromium oxide), (La, Co)$CrO_3$, (Sr, Ca)$RuO_2$, La(Fe, Al)$O_3$, and $Bi_{1.5}ZnSb_{1.5}O_7$. Further, one skilled in the art will recognize that the semiconductor coating 226 may be applied over multiple AFE coatings, such as coatings 94, 95 illustrated in FIG. 3.

Figure 8:
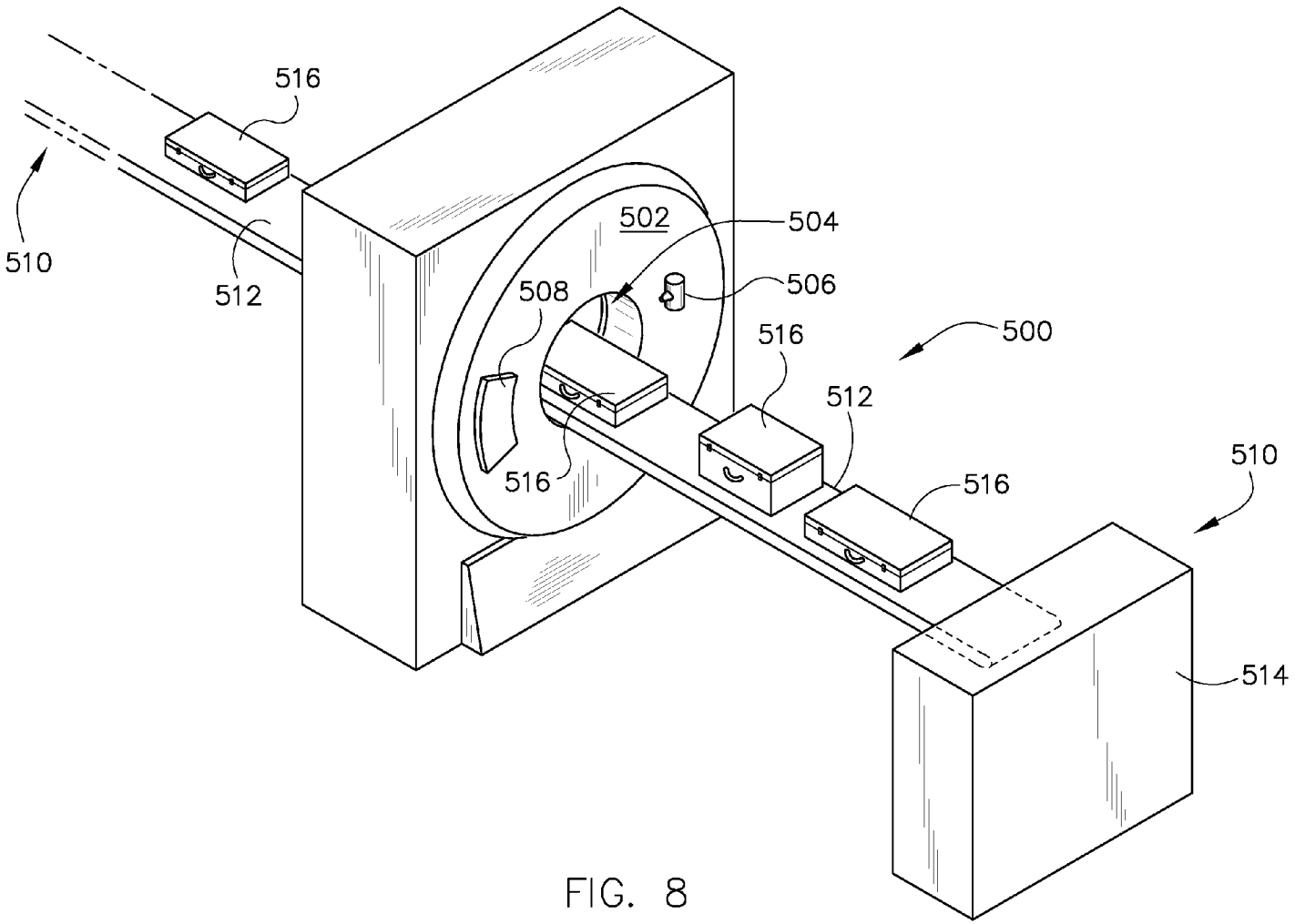
FIG. 8 is a pictorial view of a CT system for use with a non-invasive package inspection system.

FIG. 8 is a pictorial view of a CT system for use with a non-invasive package inspection system. Package/baggage inspection system 500 includes a rotatable gantry 502 having an opening 504 therein through which packages or pieces of baggage may pass. The rotatable gantry 502 houses a high frequency electromagnetic energy source 506 as well as a detector assembly 508 having scintillator arrays comprised of scintillator cells. A conveyor system 510 is also provided and includes a conveyor belt 512 supported by structure 514 to automatically and continuously pass packages or baggage pieces 516 through opening 504 to be scanned. Objects 516 are fed through opening 504 by conveyor belt 512. Imaging data is then acquired, and the conveyor belt 512 removes the packages 516 from opening 504 in a controlled and continuous manner. As a result, postal inspectors, baggage handlers, and other security personnel may non-invasively inspect the contents of packages 516 for explosives, knives, guns, contraband, etc.

While electron tube design may include various structural incarnations, the underlying principles of operation are essentially the same such that one skilled in the art will understand that the scope of the invention includes application to electron tubes generally as well as the x-ray tubes described herein.

According to one embodiment of the invention, an insulator for a vacuum tube includes an electrically insulative bulk material and a first antiferroelectric coating applied to a first portion of the bulk material.

In accordance with another embodiment of the invention, a method of manufacturing an insulator for a vacuum tube includes providing an electrically insulative bulk material and applying a first antiferroelectric coating to a first surface of the bulk material.

Yet another embodiment of the invention includes an x-ray tube assembly including a cathode, an anode, and an insulator comprising a ceramic bulk material having a first surface and a contiguous second surface. The assembly also includes a first nanoceramic coating, having a field dependent first dielectric constant, applied to the first surface.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An insulator for a vacuum tube comprising:
an electrically insulative bulk material; and
a first antiferroelectric coating applied to a first portion of the bulk material, the first portion extending from a first edge of the electrically insulative bulk material toward a second edge of the electrically insulative bulk material, wherein the first edge is configured to be positioned adjacently to a center post of a vacuum tube.

2. The insulator of claim 1 wherein the first coating has a first dielectric constant that varies nonlinearly as a function of an applied electric field.

3. The insulator of claim 2 further comprising a second antiferroelectric coating applied to a second portion of the bulk material, the second coating having a second dielectric constant that varies nonlinearly as a function of an applied electric field, wherein the second dielectric constant varies inversely with the first dielectric constant within a range of the applied electric field.

4. The insulator of claim 3 further comprising a semiconductor coating applied over the first and second coating.

5. The insulator of claim 4 wherein the semiconductor coating material comprises one of $Cr_2O_3$, an $Al_2O_3$—$Cr_2O_3$ mixture, (La,Co)$CrO_3$, (Sr,Ca)$RuO_2$, La(Fe,Al)$O_3$, $Bi_{1.5}ZnSb_{1.5}O_7$, ZnO, SiC and Si.

6. The insulator of claim 1 wherein a material of the first coating contains antiferroelectric particles comprising one of lead zirconate, sodium niobate, lead zirconate titanate, lanthanum-modified lead zirconium titanate, lead hafnate, and lanthanum-modified lead zirconate titanate stannate.

7. The insulator of claim 1 wherein the first coating thickness is 50 micrometers or less.

8. The insulator of claim 1 wherein the first coating contains antiferroelectric particles having an average particle size between approximately 5 nanometers and 1000 nanometers.

9. The insulator of claim 1 wherein the first coating is configured to undergo a phase transition, when subjected to an electrical biasing field, which results in an increase of 50% to 500% in the dielectric constant of the first coating.

10. The insulator of claim 1 wherein the first coating is configured to undergo a phase transition, when subjected to an electrical biasing field, which results in a decrease of 50% to 500% in the dielectric constant of the first coating.

11. The insulator of claim 1 wherein the first coating is configured to undergo a phase transition from a low-dielectric-constant state to a high-dielectric-constant state when subjected to an electric field of one kilovolt per millimeter to 100 kilovolts per millimeter.

12. The insulator of claim 1 wherein the bulk material comprises alumina.

13. A method of manufacturing a vacuum tube comprising:

attaching an electrically insulative bulk material to a center post of a vacuum tube; and applying a first antiferroelectric coating to a first surface portion of the bulk material to prevent the formation of an intersection of the electrically insulative bulk material, the center post, and an interior volume of the vacuum tube.

14. The method of claim 13 further comprising applying a second antiferroelectric coating to a second surface portion of the bulk material, the second coating having a dielectric constant that, in the presence of an electric field, varies inversely to a dielectric constant of the first antiferroelectric coating in the presence of the electric field.

15. The method of claim 13 wherein applying the first coating comprises applying the coating using one of plasma thermal spray, chemical vapor deposition and physical vapor deposition.

16. The method of claim 13 wherein applying the first coating comprises applying the coating using one of dip-coating and brush painting.

17. The method of claim 13 further comprising heating the bulk material to accelerate drying of the first coating.

18. An x-ray tube assembly comprising:

a cathode;

an anode; and an insulator comprising:

a ceramic bulk material having a first surface and a contiguous second surface; and a first nanoceramic coating, having a field dependent first dielectric constant, applied to the first surface.

19. The x-ray tube assembly of claim 18 wherein the first dielectric constant varies nonlinearly with an applied electric field.

20. The x-ray tube assembly of claim 19 wherein the insulator further comprises a second nanoceramic coating, having a second dielectric constant, applied to the second surface, and wherein the second dielectric constant is an inverse of the first dielectric constant in the presence of an applied electric field.

21. The x-ray tube assembly of claim 20 wherein the insulator further comprises a semiconductor coating applied to the first and second coatings.

* * * * *

UNITED STATES PATENT AND TRADEMARK OFFICE

CERTIFICATE OF CORRECTION

PATENT NO. : 7,783,012 B2
APPLICATION NO. : 12/210822
DATED : August 24, 2010
INVENTOR(S) : Cao et al.

It is certified that error appears in the above-identified patent and that said Letters Patent is hereby corrected as shown below:

In Column 6, Line 60, delete "116" and insert -- 316 --, therefor.

Signed and Sealed this

Nineteenth Day of October, 2010

David J. Kappos

David J. Kappos
*Director of the United States Patent and Trademark Office*